United States Patent [19]

Sullivan

[11] 3,959,088

[45] May 25, 1976

[54] METHOD AND APPARATUS FOR GENERATING HIGH AMPERAGE PULSES FROM AN A-C POWER SOURCE

[75] Inventor: William C. Sullivan, Watervliet, N.Y.

[73] Assignee: The United States of America as represented by the Secretary of the Army, Washington, D.C.

[22] Filed: Mar. 19, 1975

[21] Appl. No.: 559,952

[52] U.S. Cl. ..... 204/14 R; 204/228; 204/DIG. 8; 204/DIG. 9

[51] Int. Cl.[2] ..... C25D 1/00

[58] Field of Search ..... 204/14 R, 228, DIG. 8, 204/DIG. 9

[56] References Cited

UNITED STATES PATENTS

| | | | |
|---|---|---|---|
| 2,443,599 | 6/1948 | Chester | 204/228 |
| 2,548,867 | 4/1951 | Chester | 204/DIG. 9 |
| 2,939,828 | 6/1960 | Hausner | 204/228 |
| 3,616,434 | 10/1971 | Hausner | 204/228 |
| 3,752,754 | 8/1973 | Olson et al. | 204/228 |

*Primary Examiner*—T. M. Tufariello

*Attorney, Agent, or Firm*—Nathan Edelberg; Robert P. Gibson; Harold H. Card, Jr.

[57] ABSTRACT

An a-c source of power is utilized to provide periodic d-c pulses of predetermined amplitude, duration, and frequency by synchronizing the delay sweep of a cathode ray oscilloscope with the sine wave of the a-c voltage input, timing the delay sweep to provide an output signal at the desired frequency and at the particular point on the sine wave which will impart the desired voltage peak thereto, and utilizing each output signal to trigger a first silicon controlled rectifier for initiating a current pulse while simultaneously providing a corresponding signal with a given delay for firing a second silicon controlled rectifier to terminate the current pulse and establish the duration desired thereof.

9 Claims, 4 Drawing Figures

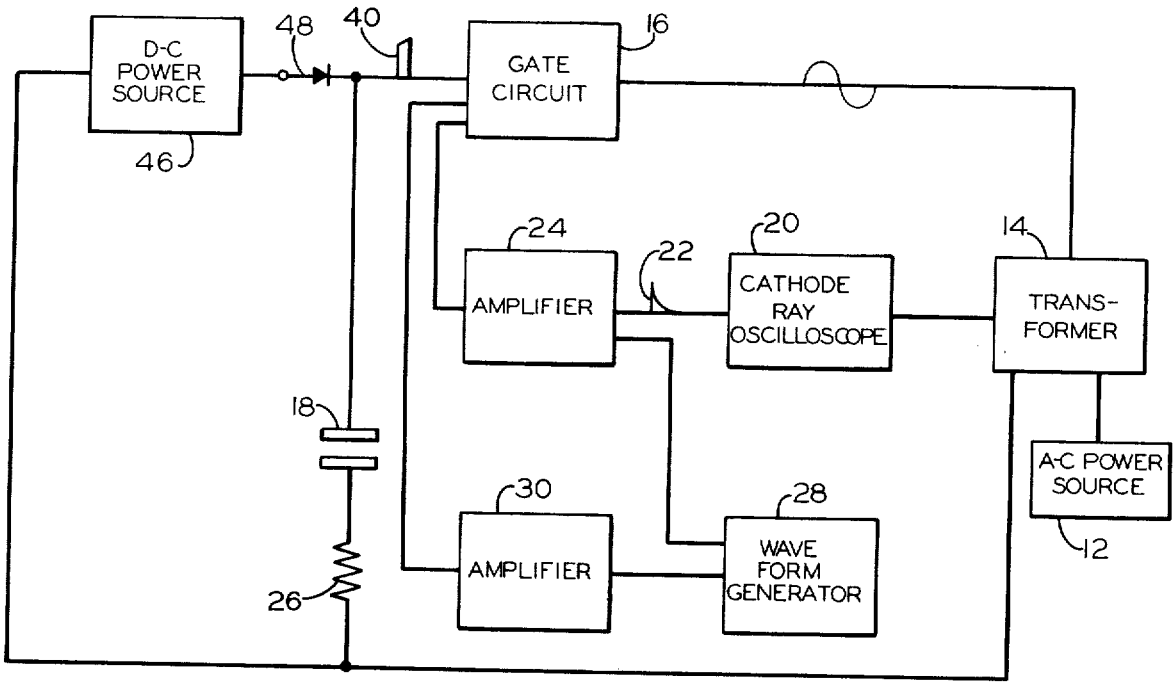
Fig. 1
Fig. 2
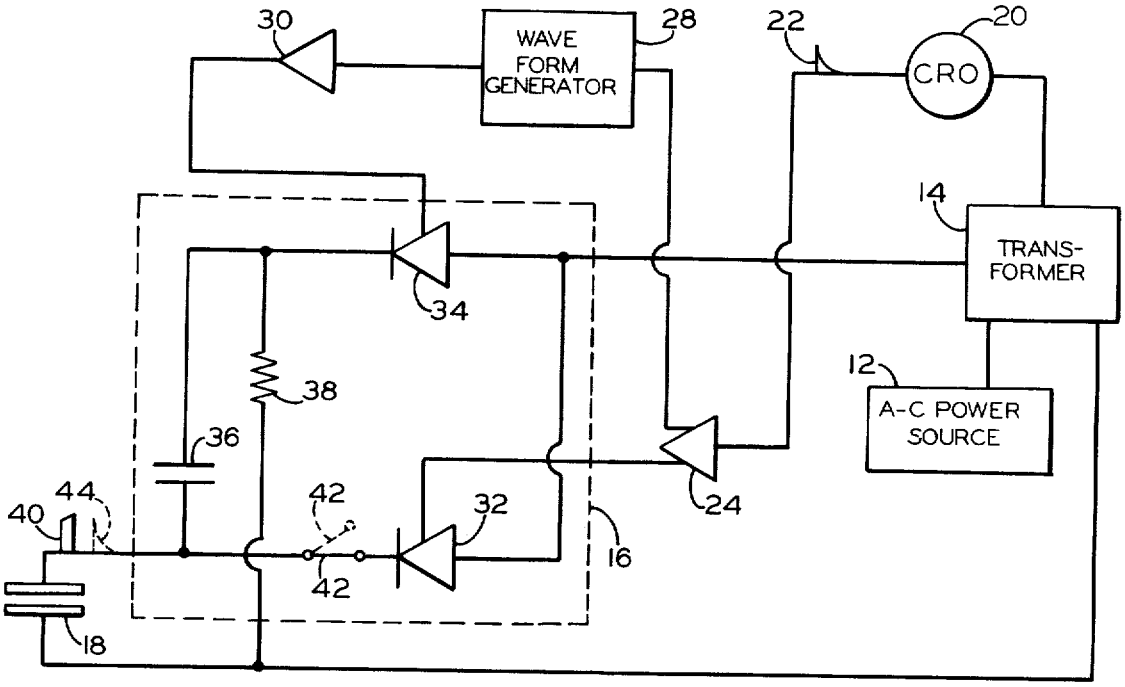

METHOD AND APPARATUS FOR GENERATING HIGH AMPERAGE PULSES FROM AN A-C POWER SOURCE

The invention described herein may be manufactured, used, and licensed by or for the Government for Governmental purposes without the payment to me of any royalties thereon.

BACKGROUND OF THE INVENTION

This invention relates to the generation of periodic pulses of applied electrical current and is more particularly directed to a method and apparatus for utilizing an alternating current power system to produce a pulsed current with a peak amperage greater than 50A.

There are many instances where the transmission of electrical current in periodic pulse form provides superior results over the continuous flow obtained with conventional systems. One example is found in the electroplating of metallic coatings on a variety of surfaces. Ordinarily, the tensile strength and ductility of the plated metal are limited to relatively low levels by the need for restricting the rate of deposit in order to prevent "burning" of the cathode by the depletion of the ions in the vicinity thereof. It has been found, however, that the rate of metal deposit can be substantially increased by passing the plating current through the electrolyte in the form of periodic pulses so that the solution equilibrium in the vicinity of the cathode is restored during the intervals between the individual pulses. The ability to plate at substantially higher rates of deposit than those ordinarily provided by continuous current power sources produces an extremely dense plate relatively free from hydrogen embrittlement. In addition, since each pulse initiates a separate nucleation site for the grain growth of the deposited metal, the undesirable columnar structure inherent in continuous current plating is virtually eliminated to produce an extremely fine-grain structure of superior resistance to stress and wear.

However, the utilization of pulsed current in the electroplating of metals has not yet met with any degree of commercial success primarily because of the relatively low amperages available at the plating cell. While it is possible to increase the power supplied by the d-c generators normally utilized in commercial plating, such solution requires complex and costly changes in the design of existing equipment in order to convert the continuous current to discrete pulses of extremely short duration. In addition, the mechanical commutators heretofore employed in the generation of pulsed current have not been able to provide the flexibility desired in the control of such parameters as the amplitude and duration of the individual pulses and the rate at which such pulses are produced.

SUMMARY OF THE INVENTION

Accordingly, it is an object of this invention to provide an electronic switching method for converting the flow of current from an a-c line source to periodic d-c pulses capable of providing peak amperages in excess of 50A.

It is another object of this invention to provide a relatively simple and economical switching circuit for generating the aforesaid pulsed current wherein the amplitude, duration and frequency of the individual pulses can be individually varied to provide maximum flexibility in meeting the particular demands of the system to be operated thereby.

A further object of the present invention resides in the provision of a switching circuit, as aforesaid, which can be efficiently utilized in the electroplating of metals to provide a plating deposit of significantly greater resistance to stress and wear than heretofore attained with conventional d-c power.

An additional object of this invention is to provide a low impedance source for delivering a pulsed current of high peak amperage capable of electroplating metal on a much larger cathode area than heretofore possible.

Still another object of this invention is to provide a switching circuit, as aforesaid, which will generate recurrent pulses of high peak amperage from an a-c power source and superimpose the pulsed current onto the current supplied to an electroplating cell from a conventional d-c power source.

It has been found that the foregoing objects can be fully achieved by a switching circuit wherein the frequency at which the individual pulses of the desired electroplating current are generated is adjustably controlled by the periodic rate at which the main sweep of a cathode ray oscilloscope is triggered by a delay sweep synchronized with an a-c voltage input. A delay time multiplier incorporated in the oscilloscope permits the speed of the delay sweep to be readily adjusted relative to the main sweep for triggering a recurrent output signal at any desired frequency and at any predetermined point along the wave form supplied by the a-c power source. Such adjustment also produces a corresponding intensity modulated spot on the viewing screen of the cathode ray tube which locates the position of the triggering point relative to the peak height of the a-c sine wave. The output signal of the oscilloscope is amplified and utilized to fire a first silicon controlled rectifier for initiating the delivery of a pulse to a plating cell. The same output signal is also utilized to function a variable delay system connected to the oscilloscope for generating a triggering signal having a predetermined delay which is amplified and transmitted to a second silicon controlled rectifier for terminating the flow of current to the plating cell to produce a pulse whose durartion is equal to the interval between the firing of the first and second rectifiers. Thus, the rectifier circuit serves as a gate for effectively supplying periodic d-c pulses taken at a desired frequency from the positive half of each cycle of the a-c input in the form of rectangular strips wherein the height thereof determines the pulse voltage peak and the width thereof determines the duration of the pulse. Such system provides a low impedance source of plating current with a capability for relatively unlimited power.

While the pulsed current can be directly utilized as the source of power for the electroplating process, the rate of deposit will be appreciably increased by providing the plating cell with a conventional d-c power supply connected thereto in parallel with the a-c pulse generating system provided suitable blocking diodes are interposed therebetween.

BRIEF DESCRIPTION OF THE DRAWINGS

The exact nature of the invention as well as other objects and advantages thereof will be readily apparent from consideration of the following specification relating to the annexed drawings, wherein:

FIG. 1 is a schematic block diagram of a system for utilizing an a-c power source to generate and transmit d-c pulses to an electroplating cell;

FIG. 2 is a similar block diagram amplified to illustrate the details of the gate circuit which controls the width of the strips taken from the a-c sine wave to provide pulses of corresponding duration;

DESCRIPTION OF A PREFERRED EMBODIMENT

Figure 3:
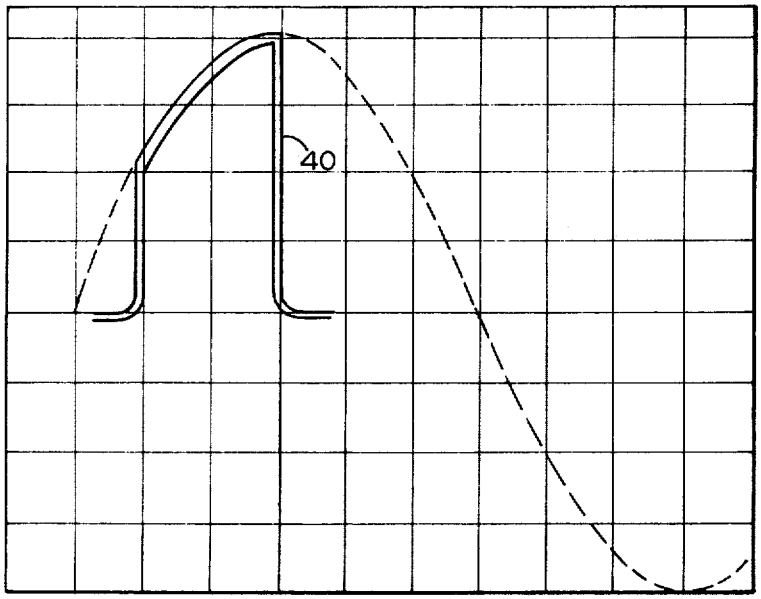
FIG. 3 is a graphic representation of the type of rectangular pulse form produced under a resistive load by the circuit of FIG. 2.

Although the pulsed current generated by the arrangement illustrated in FIG. 1 is applicable to any a-c powered system whose operation requires pulses of extremely short duration and high amperage, it is particularly valuable in the electroplating of high strength, corrosion-resistant metals such as chromium or cobalt. An a-c power source 12 supplies sine wave voltage at frequencies up to 2 megacycles but preferably at a conventional 60 cycle/sec through a suitable voltage-control device such as a transformer 14 in series with a gate circuit 16 and an electroplating cell 18. If desired, transformer 14 may be eliminated since a constant a-c may be obtained directly from the line voltage of source 12. The transformer output is supplied to a cathode ray oscilloscope 20 provided with a sweep system responsive to a wide range of internal voltage adjustments for repetitively triggering a main sweep at any desired frequency rate.

One oscilloscope meeting these requirements is the 535 Model manufactured by Tektronix Corp. of Beaverton, Oregon, which is provided with a display screen divided into one-centimeter squares for extablishing a sweep 10 centimeters long. A Miller run-up is incorporated in oscilloscope 20 to provide a delay sweep with a speed range of from 2 microseconds per centimeter to 10 milliseconds per centimeter in twelve fixed steps. In order to avoid undesirable phase shifts, such delay sweep is synchronized to the line frequency of the a-c wave form provided by power source 12. Accordingly, the delay sweep can be voltage adjusted by a 10-turn control incorporated in oscilloscope 20 to locate an intensity modulated spot at any point along the wave form of the a-c signal at which it is desired to provide a recurrent trigger for the main sweep. The 10-turn control is calibrated in centimeters of delay which can be converted into a system of time delay measurement. For example, if the delay sweep is set at 10 milliseconds per centimeter, the time to traverse the 10-centimeter length of the viewing screen on the cathode ray tube of oscilloscope 20 would be 100 milliseconds. Consequently, if the time required to initiate the next traverse of the delay sweep is added to the 100 milliseconds, the total elapsed time will be 133 milliseconds. Similarly, other settings for the delay sweep will provide the following time intervals for the triggering of the main sweep.

| Delaying Sweep Setting (in millisec/cm) | Delay Time Intervals (in milliseconds) |
|---|---|
| 1 | 17 |
| 3 | 50 |

-continued

| Delaying Sweep Setting (in millisec/cm) | Delay Time Intervals (in milliseconds) |
|---|---|
| 10 | 133 |
| 30 | 470 |
| 100 | 1800 |
| 300 | 3900 |

The triggering of the main sweep produces an output signal 22 from oscilloscope 20 which is passed through a suitable amplifier 24 and then directed to gate circuit 16 for initiating a pulse of current to electroplating cell 18. Output signal 22 is also utilized to brighten the intensity modulated spot for providing visual confirmation of the location thereof on the sine-wave form of the a-c input to oscilloscope 20. In addition, the line containing plating cell 18 is provided with a resistor 26 to permit monitoring of the plating pulses by another oscilloscope (not shown). The output signal 22 from oscilloscope 20 is also utilized to operate an externally located wave form generator 28, such as the Tektronix Model 162, which is provided with a variable delay adjustment for triggering an output signal within a desired time interval following the activation thereof. The delayed trigger from generator 28 is passed through a suitable amplifier 30 and then directed to gate circuit 16 for terminating the pulse then being supplied to electroplating cell 18. Thus, each triggering of the main sweep produces recurrent output signals 22 whose amplitude is dependent on the location of the intensity modulated spot on the a-c wave form input to oscilloscope 20. The rate or frequency at which output signals 22 are repeated is determined by the oscilloscope adjustment which controls the speed of the delay sweep. The width or duration of each pulse supplied to plating cell 18 is determined by the interval between the "on-off" switching operations of gate circuit 16.

As best shown in FIG. 2, the on-off switching provided by gate circuit 16 is preferably accomplished by silicon controlled rectifiers 32 and 34 connected in parallel arrangement and in series with electroplating cell 18. When rectifier 32 is fired by output signal 22 from oscilloscope 20, a positive spike is applied to plating cell 18 and load current will continue to flow until the half cycle from transformer 14 is terminated or until rectifier 34 is fired by the delayed trigger from generator 28. If the latter occurs first, an 11.5 microfared capacitor 36 in the line between rectifiers 32 and 34 is charged to effectively oppose the forward flow of current through rectifier 32 thereby reducing the voltage level thereof to a point below the sustaining value thereof and discharging capacitor 36 through a suitable resistor 38. Thus, each successive firing of rectifiers 32 and 34 produces a d-c pulse 40 of rectangular configuration, as best shown in FIG. 3, for a period of time equivalent to the width of the strip taken from the a-c sine wave supplied to oscilloscope 20. Where 2N4,170 rectifiers of Tektronix, Inc. design are employed, the interval between the successive firings of rectifiers 32 and 34 will range from 2.5 milliseconds to approximately 6 milliseconds at a peak current level of 30A. In the event rectifiers 32 and 34 are of the Tektronix, Inc. 2N658 or 2N687 type, the circuit will provide a constant pulse width of 120 microseconds at the base with a 40 microseconds rise time and an 80 microseconds decay time. Furthermore, where the main line voltage to rectifiers 32 and 34 is increased, the pulse voltage to electroplating cell 18 will be correspondingly increased. As a result, successful plating has been accomplished at the unusually high current level of 100A.

Figure 4:
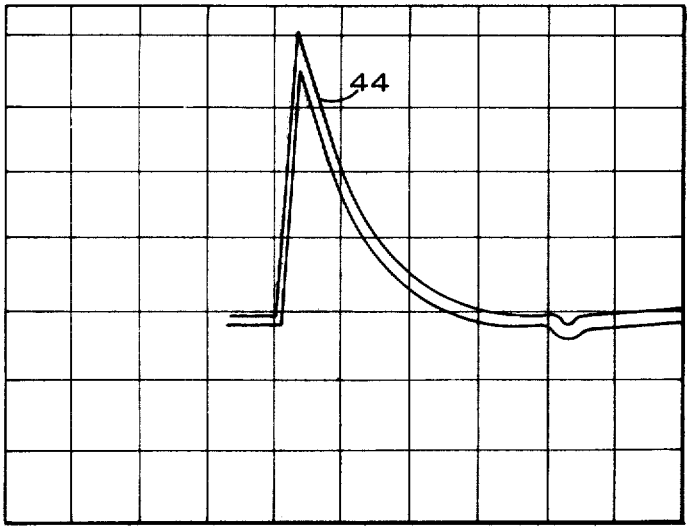
FIG. 4 is a view similar to that of FIG. 3 but showing the pulse configuration obtained when the pulses to the plating cell are initiated and terminated by a single silicon controlled rectifier.

However, if rectifier 32 is inactivated by a single-pole, single-throw switch 42 incorporated in the line leading to electroplating cell 18, the firing of rectifier 34 by the delayed trigger from wave generator 28 will provide an extremely rapid charge of capacitor 36 which will immediately begin to discharge through resistor 38. Such successive charging and discharging of capacitor 36 provides a peak type of pulse 44 in the dotted configuration shown in FIG. 2. The interval between the rise and decay of pulse 44 is controlled by wave form generator 28 in the same manner as previously described in connection with rectangular pulse 40. A representative form of peak type pulse 44 is illustrated in FIG. 4 and typically provides the following characteristics:

| | |
|---|---|
| Pulse load current | 25 amperes |
| Peak a-c load voltage | 90 volts |
| Maximum pulse width | 120 microseconds |
| Pulse repetition rate | 17 milliseconds |
| Pulse rise time | 30 microseconds |
| Pulse decay time | 90 microseconds |

The significant difference between peak pulse 44 and the constant width type of rectangular pulse 40 lies in the attainment of a far more rapid rise time, ordinarily between 20 to 40 microseconds, due to the extremely fast discharge of the particular capacitor 36 utilized in circuit 16. Thus, while the use of a single silicon controlled rectifier does not permit any predetermined variation in the width or duration of the pulses transmitted to plating cell 18, it does not provide pulses which are extremely beneficial in the electroplating of fine-grained deposits of metal even at the high peaks attained with the a-c wave forms utilized to power the pulse generating system of the present invention.

While pulses 40 and 44 can be supplied directly to electroplating cell 18, the rate of plating deposit will be appreciably increased by incorporating a conventional d-c power supply 46 in the circuit. A diode 48 is provided in the line between power supply 46 and plating cell 18 to block against the entry of the output pulses 40 or 44 from gate circuit 16. If the pulses are reversed, suitable triacs or diacs with the proper polarities may be employed to provide the desired blocking thereof. As a result, the rapid rates of plating deposit generally achieved in a conventional d-c plating system are augmented by the tremendous increase in plating density affored by the high amperage available from the a-c power supply.

The above-described plating circuit was employed to provide deposits of cobalt from a Watts type solution containing the following:

| | |
|---|---|
| $CoSO_4.7H_2O$ | 240 grams/liter (32oz/gal) |
| $CoCl_2.6H_2O$ | 45 grams/liter (6oz/gal) |
| $H_3BO_3$ | 30 grams/liter (4oz/gal) |
| $H_2O$ (double-distilled) | |

The bath was agitated with a magnetic stirrer and maintained at 40°C(104°F) and a pH of 2.0. Cobalt anodes were hung in diaphragms made of filter paper to isolate the anode sludge, and the bath was filtered daily to minimize suspended matter. All of the deposits were plated on brass substrates with an effective cathode area of 40 $cm^2$ (0.043 $ft^2$) using pulsed current densities between 50 and 100 $A/dm^2$ (465 and 930 $A/ft^2$) superimposed on a background d-c of 4$A/dm^2$ (37 $A/ft^2$). A pulse duration of 120 microseconds and a pulse repetition time of 18 milliseconds were used.

The foregoing electroplating procedure was continued until sheets varying in thickness from 80 to 100 micrometers (3.15 to 3.94 mil) were obtained. Tensile test specimens having a gage length of 1.25 cm (0.5 in) were then removed from the cobalt sheets and subjected to tensile and hardness testing. It was found that increasing the density of the pulsed current results in a corresponding increase in the yield strength of the as-plated deposits up to a maximum of 70$A/dm^2$ (650$A/ft^2$). Above such current density, the yield strength was found to decrease slightly, presumably due to the "tree" formation which appeared in the microstructure of the deposit.

In order to provide a suitable comparison between a conventional plating deposit and one prepared in accordance with the present invention, one sample was plated with a continuous direct current at 4$A/dm^2$ (37 $A/ft^2$) while another identical sample was plated with a pulse current density of 70$A/dm^2$ (650 $A/ft^2$) superimposed on a background direct current of 4$A/dm^2$ (37 $A/ft^2$). Micrographs of the two deposits show similar columnar structures but with the grain size of the pulsed deposit considerably finer than that of the conventionally prepared deposit. The observed increase in the yield strength of the pulsed deposit, up to 86% over the conventional deposit, is attributed to such refinement in grain structure.

The foregoing disclosure and description of the invention is illustrative only. Various changes may be made within the scope of the appended claims without departing from the spirit of the invention.

I claim:

1. A method for increasing the density and rate of deposit in the electroplating of metals, comprising the steps of, synchronizing the delay sweep of a cathode ray oscilloscope with the sine wave of an a-c voltage input thereto, varying the speed of the delay sweep of the oscilloscope relative to that of the main sweep thereof to produce successive output triggers at a selected frequency of repetition, adjusting the timing of the delay sweep relative to the main sweep to originate each output trigger at the particular point along the positive half cycle of the a-c sine wave input at which the voltage of such trigger will attain a desired magnitude, and amplifying each output trigger to function a rectifier gate circuit for supplying an electroplating cell with d-c pulses of predetermined duration at amperages and frequencies corresponding to the adjustments to the oscilloscope.

2. The method defined in claim 1 including the step of supplying the electroplating cell with a continuous flow of d-c voltage concurrently with the transmission of the d-c pulses thereto.

3. The method defined in claim 1 wherein the functioning of the gate circuit comprises the steps of, firing a first silicon controlled rectifier therein to initiate a d-c flow to the electroplating cell, and introducing a predetermined delay in the firing of a second silicon controlled rectifier in parallel connection with the first rectifier to terminate the d-c flow to the electroplating cell and thereby produce a pulse of current wherein the duration thereof is controlled by the delay in the firing of the second rectifier.

4. In a system for generating periodic d-c pulses for transmission to an electroplating cell, the combination of, a source of a-c voltage, a cathode ray oscilliscope having a delay sweep synchronized with the sine wave input of said a-c voltage for triggering a main sweep, first control means for adjusting the relative timing of said delay and main sweeps of said oscilloscope to locate a intensity modulated spot at a point along the sine wave commensurate with the peak amperage desired at the electroplating cell, secnd control means for adjusting the speed of said delay sweep to trigger recurrent output signals from said oscilloscope at a desired frequency rate, and a rectifier gate circuit responsive to said output signals for successively initiating and terminating a d-c flow to the electroplating cell to provide periodic current pulses at a predetermined peak amperage and duration.

5. The pulse generating system defined in claim 4 including, a source of d-c voltage located in parallel connection with said source of a-c voltage for supplying the electroplating cell with a continuous d-c flow concurrently with the transmission of said d-c pulses thereto, and a diode for blocking said d-c voltage source against said d-c pulses.

6. The pulse generating system defined in claim 4 wherein said rectifier gate circuit comprises, a first silicon controlled rectifier responsive to each of said recurrent output signals from said oscilloscope for intitiatng a d-c flow to the electroplating cell, means responsive to said oscilloscope output signals for introducing a predetermined delay in the triggering of corresponding recurrent signals, and a second silicon controlled rectifier in parallel connection with said first rectifier and responsive to said delayed signals for terminating said d-c flow to provide the electroplating cell with correspondingly recurrent pulses of current, the duration of each of said pulses being controlled by the delay imparted to said oscilloscope output signals.

7. In a system for superimposing periodic d-c pulses on a continuous supply of d-c voltage to an electroplating cell, a source of a-c voltage, a cathode ray oscilloscope connected in series with the electroplating cell and having a delay sweep synchronized with the sine wave input of said a-c voltage for triggering a main sweep to produce an output signal, a first voltage control for adjusting the timing of said main sweep relative to said delay sweep to locate an intensity modulated spot at a predetermined point along said sine wave input for providing a desired peak amperage at the electroplating cell, a second voltage control for adjusting the speed of said delay sweep to trigger recurrent output signals at a predetermined frequency rate, a first silicon controlled rectifier responsive to said output signals for initiatng a d-c flow to said electroplating cell, a second controlled rectifier disposed in parallel connection with said first rectifier for terminating said d-c flow to provide the electroplating cell with pulses of current corresponding to the frequency of said output signals from said oscilloscope, and a wave form generator responsive to said oscilloscope output signals for providing delayed triggers for firing said second silicon controlled rectifier, the duration of each of said pulses determined by the delay introduced into the firing of said second rectifier.

8. The system defined in claim 7 including a capacitor disposed between said second rectifier and the electroplating cell and in electrical communication with said first rectifier whereby the charge imparted to said capacitor by the firing of said second rectifier opposes the flow of current through said first rectifier to reduce the voltage thereof below a sustaining value and thereby terminate the d-c flow to the electroplating cell.

9. The system defined in claim 8 including a switch disposed between said first rectifier and the connection thereof to said capacitor for movement between a closed position wherein said d-c flow from said first rectifier is transmitted to the electroplating cell and an open position wherein said first rectifier is inactivated whereby said delayed trigger from said wave generator successively charges and discharges said capacitor to provide a d-c pulse the duration of which is fixed by the interval required to charge and discharge said capacitor.

* * * * *